US010756407B2

(12) United States Patent
Chueh

(10) Patent No.: US 10,756,407 B2
(45) **Date of Patent: *Aug. 25, 2020**

(54) POWER DISTRIBUTION CIRCUIT AND MULTIPLEX POWER DISTRIBUTION CIRCUIT

(71) Applicant: NANNING FUGUI PRECISION INDUSTRIAL CO., LTD., Nanning (CN)

(72) Inventor: Yu-Chih Chueh, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/509,625

(22) Filed: Jul. 12, 2019

(65) Prior Publication Data

US 2019/0363421 A1 Nov. 28, 2019

Related U.S. Application Data

(63) Continuation of application No. 15/719,572, filed on Sep. 29, 2017, now Pat. No. 10,476,125.

(51) Int. Cl.

| | |
|---|---|
| ***H01P 5/18*** | (2006.01) |
| ***H01P 5/12*** | (2006.01) |
| ***H01P 5/16*** | (2006.01) |

(52) U.S. Cl.

CPC ..... *H01P 5/184* (2013.01); *H01P 5/12* (2013.01); *H01P 5/16* (2013.01)

(58) Field of Classification Search

CPC ..... H01P 5/184; H01P 5/12; H01P 5/16

USPC ..... 333/109

See application file for complete search history.

(56) References Cited

U.S. PATENT DOCUMENTS

| | | | | |
|---|---|---|---|---|
| 5,150,084 | A * | 9/1992 | Asa | H01P 1/2135 333/128 |
| 9,923,531 | B2 * | 3/2018 | Chueh | H01P 5/12 |
| 2011/0248796 | A1 * | 10/2011 | Pozgay | G01S 13/4463 333/137 |
| 2015/0280305 | A1 * | 10/2015 | Chueh | H01P 1/203 333/134 |

* cited by examiner

*Primary Examiner* — Robert J Pascal
*Assistant Examiner* — Kimberly E Glenn
(74) *Attorney, Agent, or Firm* — ScienBiziP, P.C.

(57) ABSTRACT

A power distribution circuit includes a first portion, a second portion, a third portion, an isolation element, a first transmission sub-circuit and a second transmission sub-circuit. The first portion, the second portion, and the third portion are coupled to respective external components. The isolation element is coupled between the second portion and the third portion. The first transmission sub-circuit is set on one side of the isolation element, and is coupled between the first portion and the second portion. The second transmission sub-circuit is set on the other side of the isolation element, and is coupled between the first portion and the third portion. The first transmission sub-circuit and the second transmission sub-circuit are symmetrically set on both sides of the isolation element.

17 Claims, 8 Drawing Sheets

POWER DISTRIBUTION CIRCUIT AND MULTIPLEX POWER DISTRIBUTION CIRCUIT

CROSS REFERENCE TO RELATED APPLICATIONS

This application is a Continuation of U.S. patent application Ser. No. 15/719,572, filed on Sep. 29, 2017 and entitled "POWER DISTRIBUTION CIRCUIT AND MULTIPLEX POWER DISTRIBUTION CIRCUIT", the entirety content of which is incorporated by reference herein.

FIELD

The subject matter herein generally relates to electronic circuits, and particularly to a power distribution circuit and a multiplex power distribution circuit.

BACKGROUND

A power divider is a basic component of a microwave circuit because it has the function of separating and combining signals, so it is commonly applied in antenna arrays, balanced circuit mixers and phase shifters. At present, the Wilson power divider first proposed by E. Wilkinson in 1960 is a commonly used power divider. However, the length of the conventional Wilkinson power divider is designed to be a quarter of the operating frequency, occupying a large printed circuit board (PCB) area. Moreover, while the conventional Wilkinson power divider has a wide operating bandwidth, it lacks a harmonic suppression function. In order to suppress the certain harmonics, an external filter is required, which greatly increases the cost.

BRIEF DESCRIPTION OF THE DRAWINGS

Implementations of the present technology will now be described, by way of example only, with reference to the attached figures.

DETAILED DESCRIPTION

Figure 1:
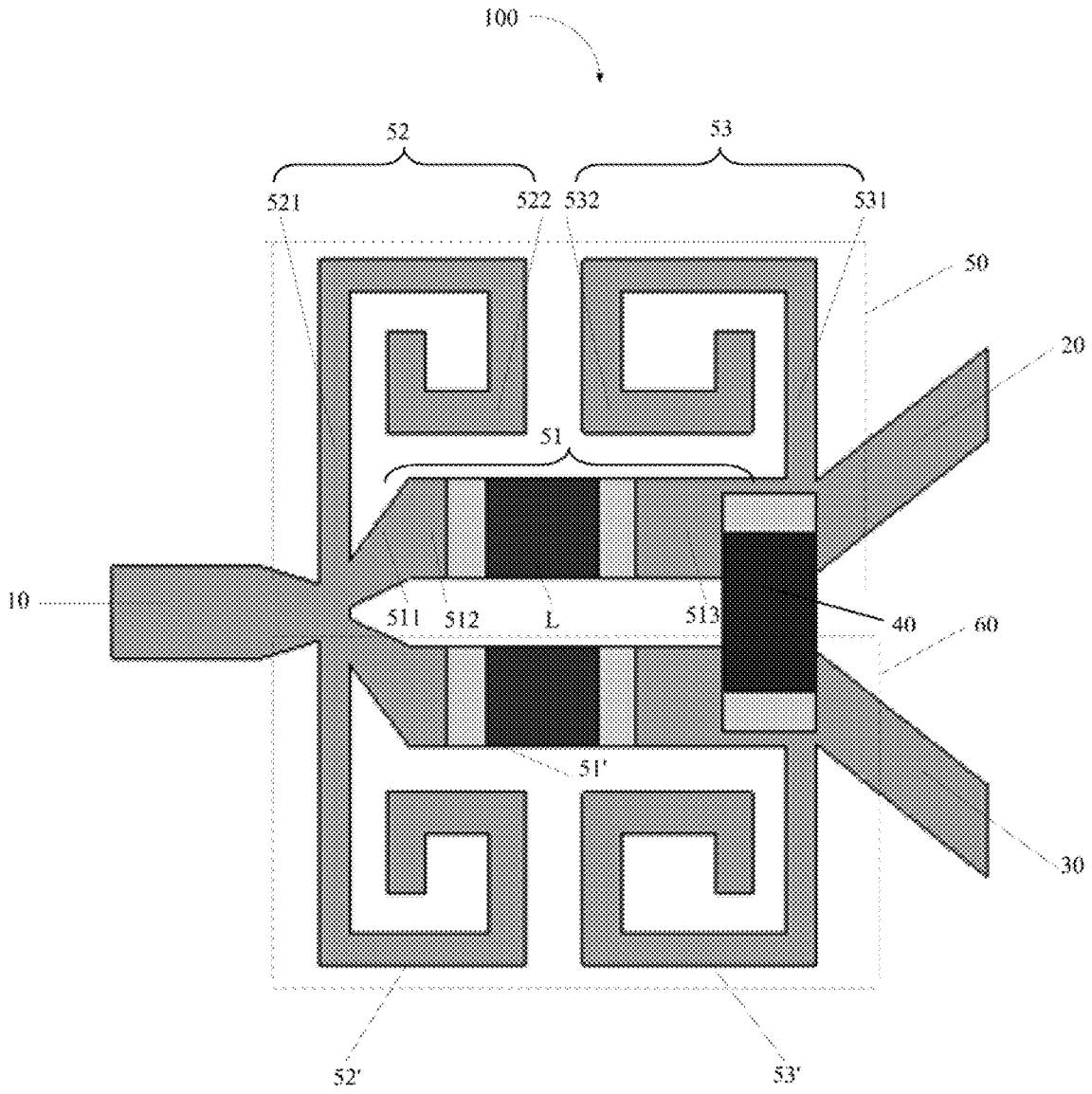
FIG. 1 is a structural diagram of an embodiment of a power distribution circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

The disclosure is described in relation to a power distribution circuit and a multiplex power distribution circuit.

FIG. 1 illustrates a structural diagram of an embodiment of a power distribution circuit 100. In at least one embodiment, the power distribution circuit 100 is provided on a substrate (not shown). The power distribution circuit 100 comprises a first portion 10, a second portion 20, a third portion 30, an isolation element 40, a first transmission sub-circuit 50 and a second transmission sub-circuit 60.

In at least one embodiment, the power distribution circuit 100 may be a power divider circuit or a power combiner circuit. When the power distribution circuit 100 is used as the power divider circuit, the power distribution circuit 100 divides power of signals. Herein the first portion 10 is coupled to an output port of external components to receive signals from the external components, and the second portion 20 and the third portion 30 are coupled to input ports of external components respectively to output a first output signal and a second output signal to the external components. When the power distribution circuit 100 is used as power combiner circuit, the power distribution circuit 100 combines power of signals. Herein, the first portion 10 is coupled to an input port of external components to output signals to the external components, and the second portion 20 and the third portion 30 are coupled to output ports of external components respectively to receive a first input signals and a second input signals from the external components.

The isolation element 40 is coupled between the second portion 20 and the third portion 30 to isolate signals between the second portion 20 and the third portion 30. Thus, interference among different signals is reduced. In the embodiment, the isolation element 40 is preferably an isolation resistor.

The first transmission sub-circuit 50 set on one side of the isolation element 40 is coupled between the first portion 10 and the second portion 20. The first transmission sub-circuit 50 comprises a signal transmission line 51, a first open transmission line 52 and a second open transmission line 53. The first open transmission line 52 and the second open transmission 53 are coupled to respective ends of the signal transmission line 51.

The second transmission sub-circuit 60 set on the other side of the isolation element 40 is coupled between the first portion 10 and the third portion 30. In at least one embodiment, the circuit structures of the first transmission sub-circuit 50 and the second transmission sub-circuit 60 are substantially identical, and the first transmission sub-circuit 50 and the second transmission sub-circuit 60 are symmetrically set on both sides of the isolation element 40. The second transmission sub-circuit 60 comprises a signal transmission line 51', a first open transmission line 52' and a second open transmission line 53'. The first open transmission line 52' and the second open transmission 53' are coupled to respective ends of the signal transmission line 51.

In an embodiment, the first open transmission line 52 in the first transmission sub-circuit 50 comprises a first microstrip line 521 and a second microstrip line 522. The first microstrip line 521 forms an L-shape. A first end of the first microstrip line 521 is coupled vertically to a first end of the signal transmission line 51. The second microstrip line 522 forms a J-shape. A first end of the second microstrip line 522 is coupled to a second end of the first microstrip line 521, and a second end of the second microstrip line 522 is in an open state. In the embodiment, the width of the first microstrip line 521 is narrower than the width of the second microstrip line 522.

In another embodiment, the second open transmission line 53 in the first transmission sub-circuit 50 comprises a third microstrip line 531 and a fourth microstrip line 532. The third microstrip line 531 forms an L-shape. A bending direction of the third microstrip line 531 is opposite to a bending direction of the first microstrip line 521. In other words, the L-shape of the third microstrip line 531 is the L-shape of the first microstrip line 521 rotated by 180 degrees. A first end of the third microstrip line 531 is coupled vertically to a second end of the signal transmission line 51. The fourth microstrip line 532 forms a J-shape. A bending direction of the fourth microstrip line 532 is opposite to a bending direction of the second microstrip line 522. In other words, the J-shape of the fourth microstrip line 532 is the J-shape of the second microstrip line 522 rotated by 180 degrees. A first end of the fourth microstrip line 532 is coupled to a second end of the third microstrip line 531, and a second end of the fourth microstrip line 532 is in an open state. In at least one embodiment, the width of the third microstrip line 531 is narrower than the width of the fourth microstrip line 532. The width of the third microstrip line 531 is equal to the width of the first microstrip line 521, and the width of the fourth microstrip line 532 is equal to the width of the second microstrip line 522. In at least one embodiment, the second microstrip line 522 is not connected to the fourth microstrip line 532, and a rectangular gap 70 is formed between the second microstrip line 522 and the fourth microstrip line 532. In the embodiment, the coupling capacitance value between the second microstrip line 522 and the fourth microstrip line 532 can be adjusted by changing the width of the rectangular gap 70.

In another embodiment, the signal transmission line 51 in the first transmission sub-circuit 50 comprises a matching portion 511, a fifth microstrip line 512, an inductor L, and a sixth microstrip line 513. The matching portion 511, the fifth microstrip line 512, the inductor L, and the sixth microstrip line 513 are coupled in series. The matching portion 511 is a microstrip line structure. The microstrip line width of the matching portion 511 is gradually widened from the first portion 10 toward the fifth microstrip line 512 for achieving impedance matching.

In at least one embodiment, since the first transmission sub-circuit 50 and the second transmission sub-circuit 60 are symmetrically arranged with respect to the isolation element 40. In other words, the circuit structure of the first transmission sub-circuit 50 and the second transmission sub-circuit 60 is consistent. Therefore, the structures of the signal transmission line 51', the first open transmission line 52', the second open transmission line 53', the first open transmission line 52', and the second open transmission line 53' of the transmission sub-circuit 60 will not be described again for brevity.

In the embodiment, a low-pass resonant circuit formed by a signal transmission line, a first open transmission line and a second open transmission line to inhibit, suppress, or filter harmonics, without the need for an external filter.

Figure 2:
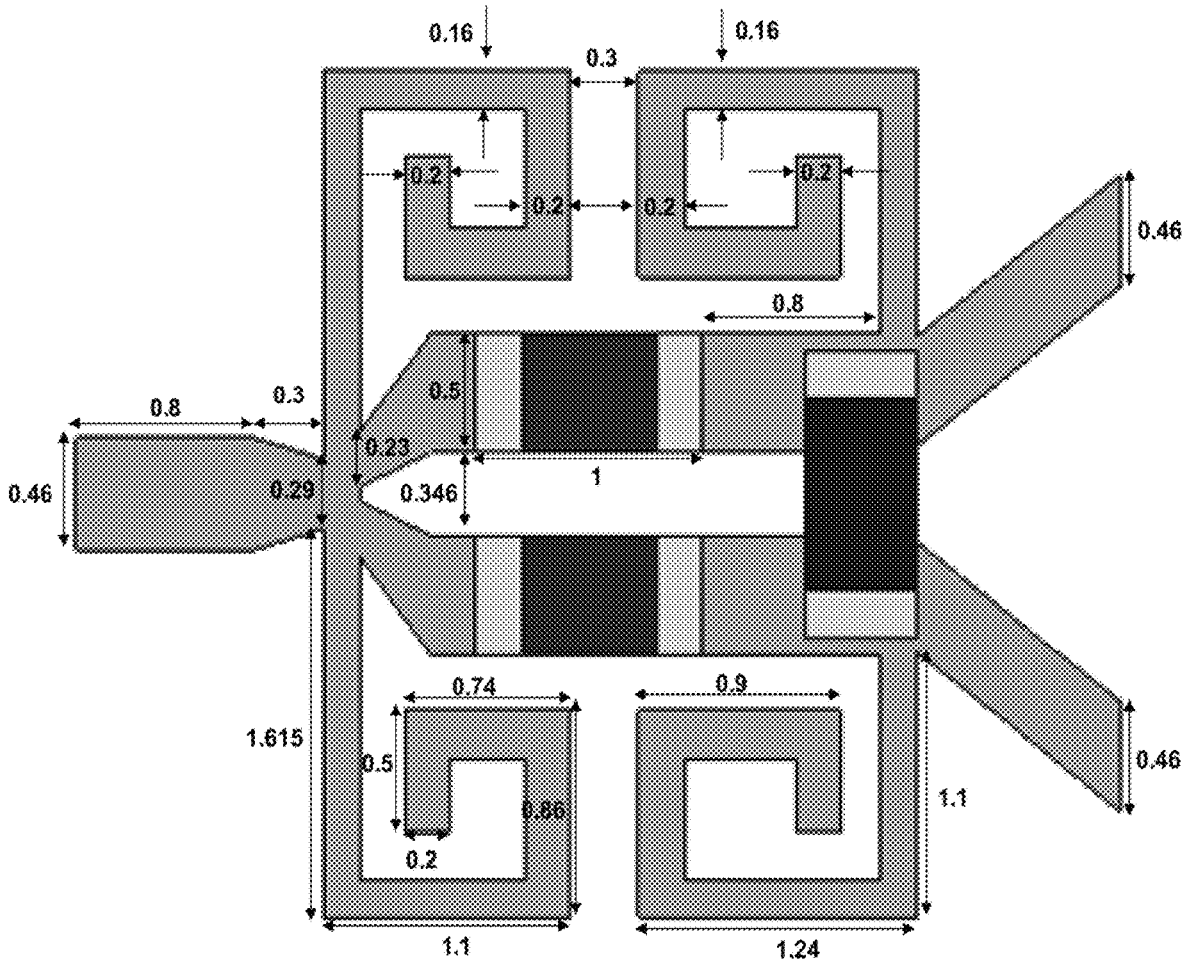
FIG. 2 is a size diagram of an embodiment of the power distribution circuit.

FIG. 2 illustrates a size diagram of an embodiment of a power distribution circuit 100. It should be noted that the dimensions shown in FIG. 2 are by example only, and not intended to limit the scope of this application in any way. In one implementation, the dimensions shown in FIG. 2 are in millimeters (mm).

Figure 3:
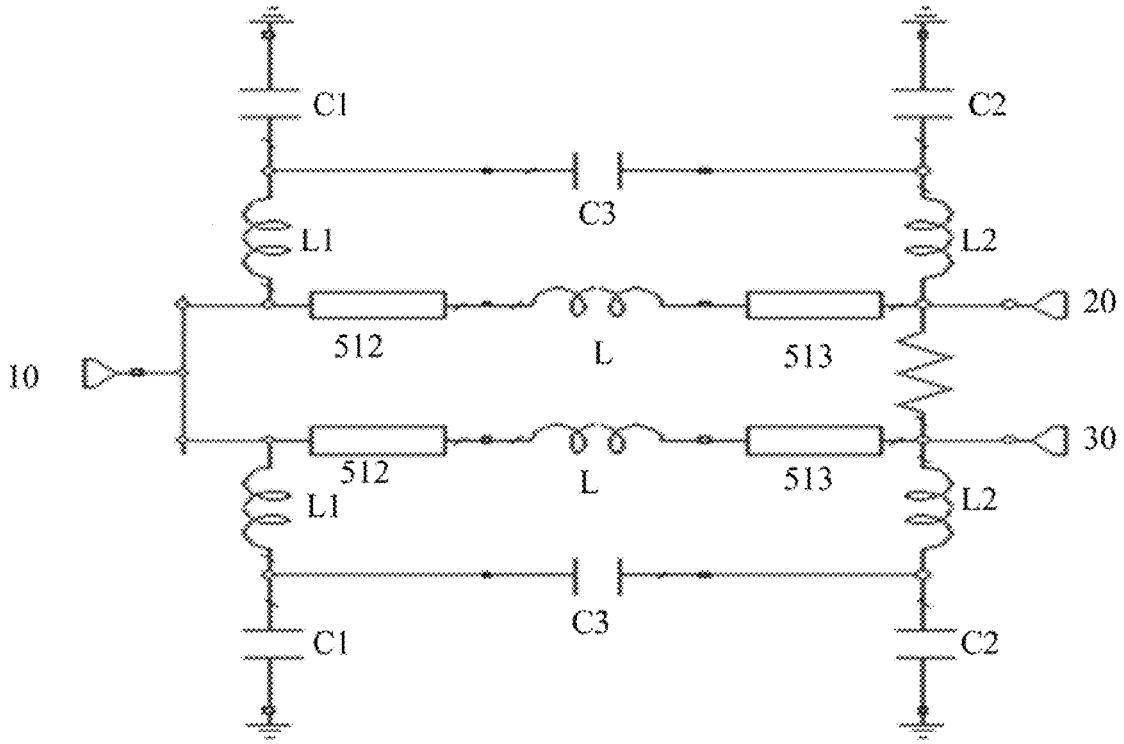
FIG. 3 is an equivalent circuit diagram of an embodiment of the power distribution circuit.

Referring to FIG. 3, FIG. 3 illustrates an equivalent circuit diagram of an embodiment of the power distribution circuit 100. In at least one embodiment, the first open transmission 52 is equivalent to a first inductor L1 and a first capacitor C1, which are coupled in series, where a first terminal of the first inductor L1 is coupled to a first end of the fifth microstrip line 512, a second terminal of the first inductor L1 is coupled a first terminal of the first capacitor C1, and a second terminal of the first capacitor C1 is coupled the ground. The second open transmission 53 is equivalent to a second inductor L2 and a second capacitor C2, which are coupled in series, where a first terminal of the second inductor L2 is coupled to a first end of the sixth microstrip line 513, a second terminal of the second inductor L2 is coupled a first terminal of the second capacitor C2, and a second terminal of the second capacitor C2 is coupled the ground. A coupling capacitor between the second microstrip line 522 and the fourth microstrip line 532 is equivalent to a third capacitor C3. A first terminal of the third capacitor C3 is coupled to the common terminal of the first inductor L1 and the first capacitor C1, and a second terminal of the third capacitor C3 is coupled to the common terminal of the second inductor L2 and the second capacitor C2. The first portion 10 is coupled to the first terminal of the first inductor L1 and the first end of the fifth microstrip line 512. A second end of the fifth microstrip line 512 is coupled to a first terminal of the inductor L, and the second terminal of the inductor L is coupled to the first end of the sixth microstrip line 513. A second end of the sixth microstrip line 513 is coupled to the second portion 20 (or the third portion 30). In the embodiment, the resonant frequency of the series resonant circuit composed of the first inductor L1 and the first capacitor C1 is equal to the resonant frequency of the series resonant circuit composed of the second inductor L2 and the second capacitor C2.

Figure 4:
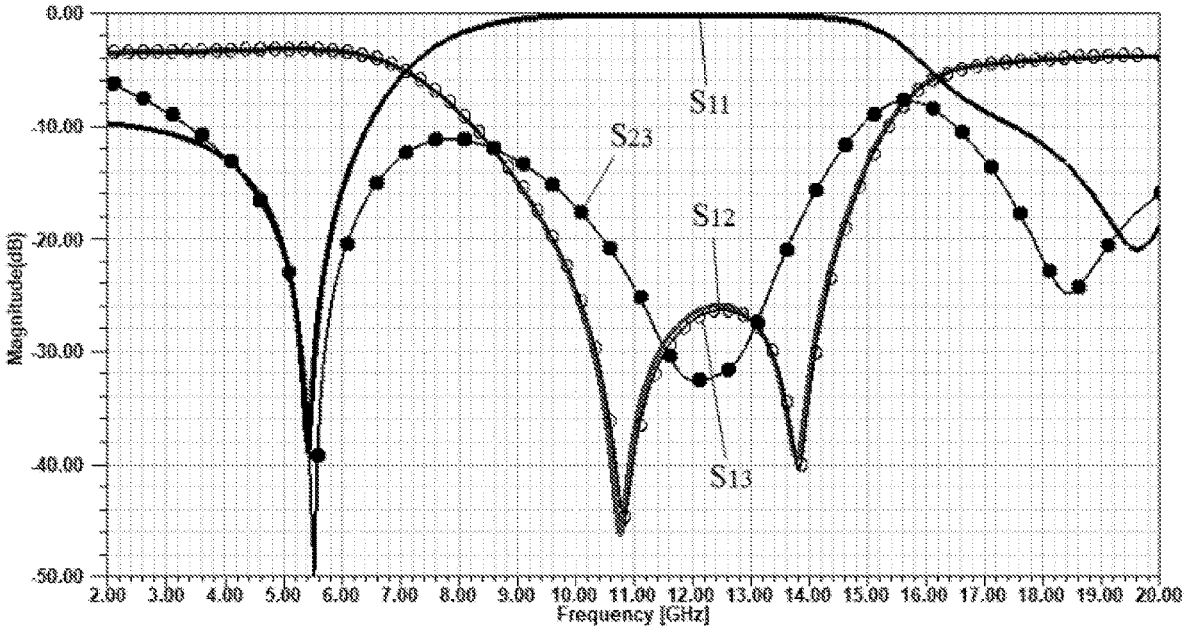
FIG. 4 is a simulation curve diagram showing an S parameter (scattering parameter) of an embodiment of the power distribution circuit.

FIG. 4 illustrates a simulation curve diagram showing an S parameter (scattering parameter) of an embodiment of the power distribution circuit 100. Curve $S_{11}$ shows a simulation curve of a reflection loss (return loss) of the first portion 10. Curve $S_{12}$ shows a simulation curve of an insertion loss from the first portion 10 to the second portion 20. Curve $S_{13}$ shows a simulation curve of an insertion loss from the first portion 10 to the third portion 30. Curve $S_{13}$ shows a simulation curve of an isolation between the first portion 20 and the third portion 30. As shown in the FIG. 4, when the power distribution circuit 100 works at a frequency about 5.5 gigahertz (GHz), the reflection loss is less than 30 decibels (dB), that is RF signals can be well transmitted between the first portion 10 and the second portion 20 (or the third portion 30). When the power distribution circuit 100 works at the frequency band of 10-14 GHz, the reflection loss is about equal to 0 dB, that is the RF signals having a frequency of 10-14 GHz can not be transmitted between the first portion 10 and the second portion 20 (or the third portion 30). The insertion loss from the first portion 10 to the second portion 20 and the insertion loss from the first portion 10 to the third portion 30 are about 4 dB when the power distribution circuit 100 works at a frequency about 5.5 GHz. The insertion loss satisfies requirements. The insertion loss from the first portion 10 to the second portion 20 and the insertion loss from the first portion 10 to the third portion 30 are both less than 20 dB when the power distribution circuit 100 works at the frequency band of 10-14 GHz. When the power distribution circuit 100 works at a frequency about 11 GHz, the insertion loss is less than 40 dB. When the power distribution circuit 100 works at a frequency about 13.8 GHz, the insertion loss is close to 40 dB. Therefore, the power distribution circuit 100 can effectively inhibit the second harmonic, particularly inhibit the second harmonic of operating frequency about 5.5 GHz and 7.9 GHz. The isolation between the second portion 20 and the third portion 30 is less than 40 dB when the power distribution circuit 100 works at a frequency about 5.5 GHz. The isolation satisfies requirements.

Figure 5:
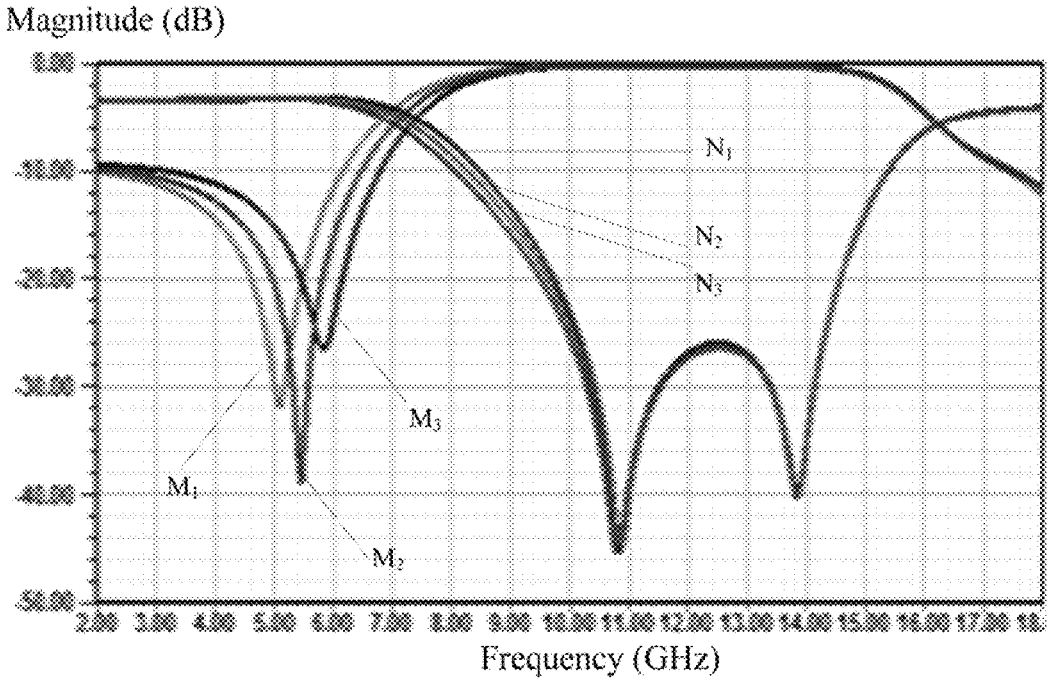
FIG. 5 is a simulation curve diagram showing an S parameter of another embodiment of the power distribution circuit.

FIG. 5 illustrates a simulation curve diagram showing an S parameter of another embodiment of the power distribution circuit 100. Curve $M_1$ shows a simulation curve of a reflection loss of the first portion 10 when the inductance value of the inductance L in the power distribution circuit 100 is 1.5 nH. Curve $N_1$ shows a simulation curve of an insertion loss from the first portion 10 to the second portion 20 when the inductance value of the inductance L in the power distribution circuit 100 is 1.5 nH. Curve $M_2$ shows a simulation curve of a reflection loss of the first portion 10 when the inductance value of the inductance L in the power distribution circuit 100 is 1.3 nH. Curve $N_2$ shows a simulation curve of an insertion loss from the first portion 10 to the second portion 20 when the inductance value of the inductance L in the power distribution circuit 100 is 1.3 nH. Curve $M_3$ shows a simulation curve of a reflection loss of the first portion 10 when the inductance value of the inductance L in the power distribution circuit 100 is 1.1 nH. Curve $N_3$ shows a simulation curve of an insertion loss from the first portion 10 to the second portion 20 when the inductance value of the inductance L in the power distribution circuit 100 is 1.1 nH. As shown in the FIG. 5, when the inductance value of the inductance L in the power distribution circuit 100 is changed, the simulation curve of a reflection loss of the first portion 10 is changed. However, the simulation curve of an insertion loss from the first portion 10 to the second portion 20 is almost unchanged. That is, the insertion loss characteristic of the power distribution circuit 100 can be improved by adjusting the inductance value of the inductance L in the power distribution circuit 100, and have little influence for the reflection loss characteristic of the power distribution circuit 100.

Figure 6:
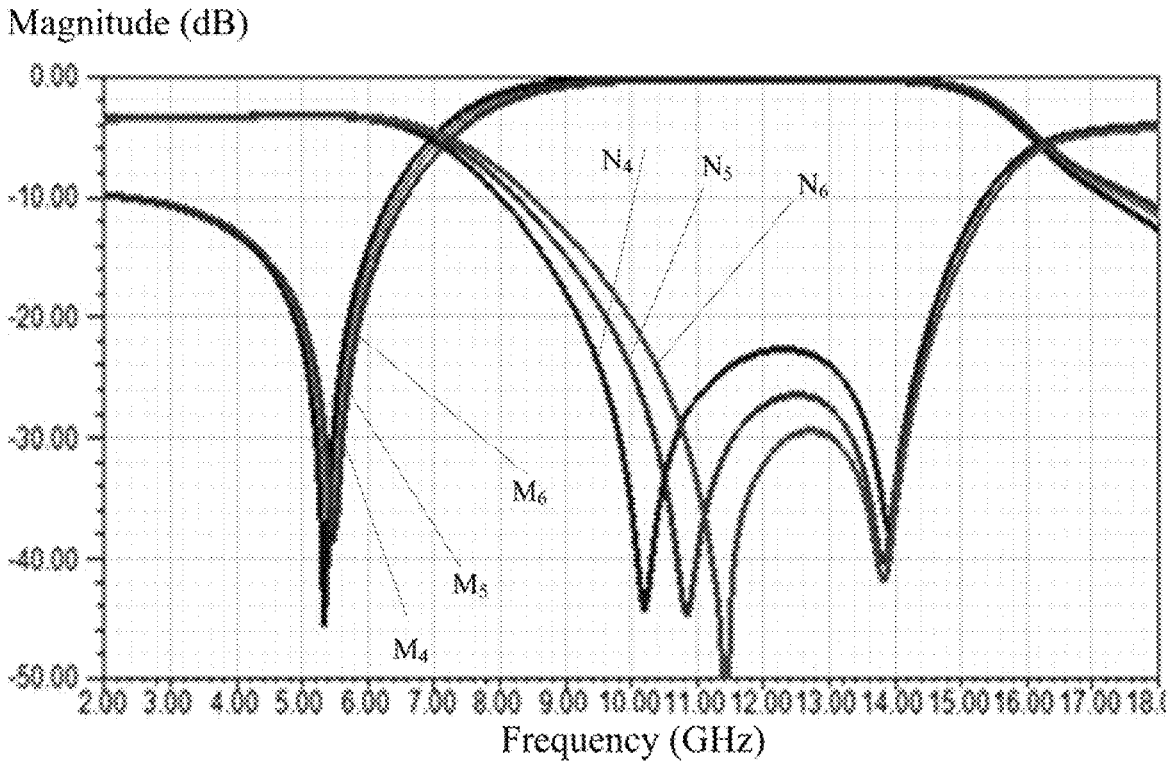
FIG. 6 is a simulation curve diagram showing an S parameter of another embodiment of the power distribution circuit.

FIG. 6 illustrates a simulation curve diagram showing an S parameter of another embodiment of the power distribution circuit 100. Curve $M_4$ shows a simulation curve of a reflection loss of the first portion 10 when the width of the rectangular gap 70 in the power distribution circuit 100 is 0.2 mm. Curve $N_4$ shows a simulation curve of an insertion loss from the first portion 10 to the second portion 20 when the width of the rectangular gap 70 in the power distribution circuit 100 is 0.2 mm. Curve $M_5$ shows a simulation curve of a reflection loss of the first portion 10 when the width of the rectangular gap 70 in the power distribution circuit 100 is 0.3 mm. Curve $N_5$ shows a simulation curve of an insertion loss from the first portion 10 to the second portion 20 when the width of the rectangular gap 70 in the power distribution circuit 100 is 0.3 mm. Curve $M_6$ shows a simulation curve of a reflection loss of the first portion 10 when the width of the rectangular gap 70 in the power distribution circuit 100 is 0.4 mm. Curve $N_6$ shows a simulation curve of an insertion loss from the first portion 10 to the second portion 20 when the width of the rectangular gap 70 in the power distribution circuit 100 is 0.4 mm. As shown in the FIG. 6, when the width of the rectangular gap 70 in the power distribution circuit 100 is changed, the simulation curve of an insertion loss from the first portion 10 to the second portion 20 is changed. However, the simulation curve of a reflection loss of the first portion 10 is almost unchanged. In other word, the reflection loss characteristic of the power distribution circuit 100 can be improved by adjusting the width of the rectangular gap 70 in the power distribution circuit 100, and have little influence for the insertion loss characteristic of the power distribution circuit 100.

Figure 7:
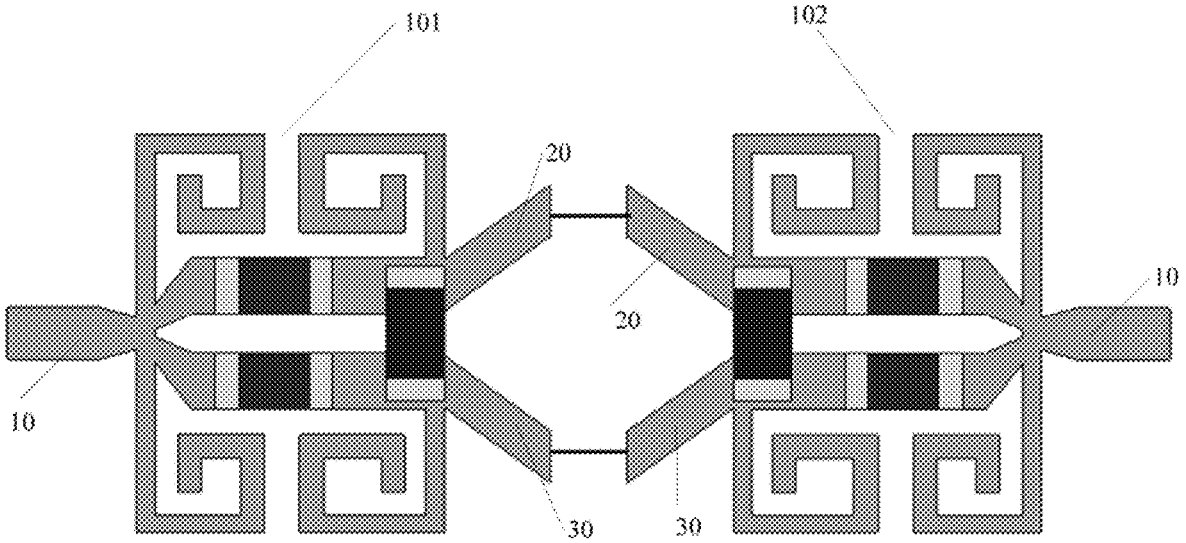
FIG. 7 is a schematic diagram of an embodiment of a two-way power distribution circuits.

FIG. 7 illustrates a schematic diagram of one embodiment of a two-way power distribution circuits. The two-way power distribution circuits may be a connection path of the power distribution circuits. The two-way power distribution circuits may comprise a first power distribution circuit 101 and a second power distribution circuit 102. A second portion 20 and a third portion 30 of the first power distribution circuits 101 are coupled to a second portion 20 and a third portion 30 of the second power distribution circuits 102 respectively. A first portion 10 of the first power distribution circuits 101 is regarded as an input terminal, and a first portion 10 of the second power distribution circuits 102 is regarded as an output terminal. The filter performance can be enhanced by connecting the second portion 20 and the third portion 30 of at least two power distribution circuits respectively.

Figure 8:
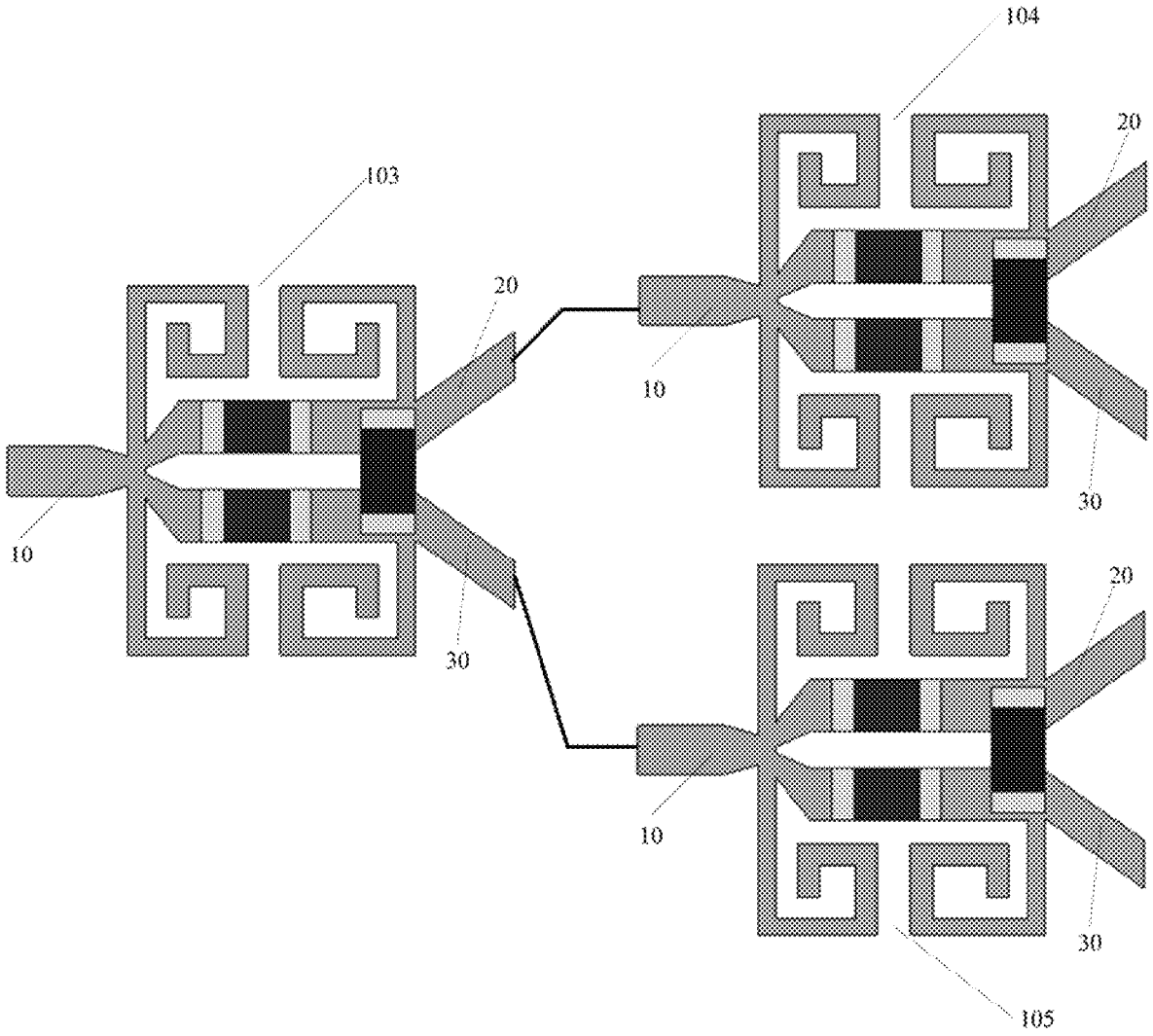
FIG. 8 is a schematic diagram of an embodiment of a multiplex power distribution circuits.

FIG. 8 illustrates a schematic diagram of one embodiment of a multiplex power distribution circuit. In the embodiment, the multiplex power distribution circuit comprises a first power distribution circuit 103, a second power distribution circuit 104 and a third power distribution circuit 105. A second portion 20 and a third portion 30 of the first power distribution circuit 103 are coupled to a first portion 10 of the second power distribution circuit 104 and a first portion 10 of the third power distribution circuit 105 respectively to form a cascade connection of a four-way power distribution circuit. In other embodiments, according to the similar connection of FIG. 8, it can be further extended to an eight-way, a sixteen-way power distribution circuit and so on.

Many details are often found in the art such as the other features of the power distribution circuit and the multiplex power distribution circuit. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A power distribution circuit, comprising:

a first portion, a second portion and a third portion;

an isolation element, coupled between the second portion and the third portion;

a first transmission sub-circuit set on one side of the isolation element, and coupled between the first portion and the second portion; and a second transmission sub-circuit set on the other side of the isolation element, and coupled between the first portion and the third portion, wherein the first transmission sub-circuit and the second transmission sub-circuit are symmetrically set on two sides of the isolation element;

wherein the first transmission sub-circuit and the second transmission sub-circuit each comprise a signal transmission line and a first open transmission line coupled to a first end of the signal transmission line, and wherein the first open transmission line comprises:

a first microstrip line forming an L-shape, wherein a first end of the first microstrip line is coupled to the first end of the signal transmission line; and a second microstrip line forming a J-shape, wherein a first end of the second microstrip line is coupled to a second end of the first microstrip line, and a second end of the second microstrip line is in an open state.

2. The power distribution circuit of claim 1, wherein the first transmission sub-circuit and the second transmission sub-circuit each further comprises a second open transmission line coupled to a second end of the signal transmission line.

3. The power distribution circuit of claim 2, wherein the second open transmission line comprises:

a third microstrip line forming an L-shape, wherein a bending direction of the third microstrip line is opposite to a bending direction of the first microstrip line, and a first end of the third microstrip line is coupled vertically to a second end of the signal transmission line; and a fourth microstrip line forming a J-shape, wherein a bending direction of the fourth microstrip line is opposite to a bending direction of the second microstrip line, a first end of the fourth microstrip line is coupled to a second end of the third microstrip line, and a second end of the fourth microstrip line is in an open state.

4. The power distribution circuit of claim 3, wherein a width of the first microstrip line is narrower than a width of the second microstrip line, and a width of the third microstrip line is narrower than a width of the fourth microstrip line.

5. The power distribution circuit of claim 4, wherein a rectangular gap is formed between the second microstrip line and the fourth microstrip line.

6. The power distribution circuit of claim 1, wherein the signal transmission line comprises a matching portion, a fifth microstrip line, an inductor and a sixth microstrip line coupled in series.

7. The power distribution circuit of claim 6, wherein the matching portion is a microstrip line structure, and a width of the microstrip line of the matching portion is gradually widened from the first portion toward the fifth microstrip line.

8. The power distribution circuit of claim 1, wherein the isolation element is an isolation resistor.

9. A multiplex power distribution circuit, comprising a plurality of power distribution circuits connected together, wherein each power distribution circuit of the multiplex power distribution circuits comprises:

a first portion, a second portion and a third portion;

an isolation element, coupled between the second portion and the third portion;

a first transmission sub-circuit set on one side of the isolation element, and coupled between the first portion and the second portion; and a second transmission sub-circuit set on the other side of the isolation element, and coupled between the first portion and the third portion, wherein the first transmission sub-circuit and the second transmission sub-circuit are symmetrically set on two sides of the isolation element;

wherein the first transmission sub-circuit and the second transmission sub-circuit each comprise a signal transmission line and a first open transmission line coupled to a first end of the signal transmission line, and wherein the first open transmission line comprises:

a first microstrip line forming an L-shape, wherein a first end of the first microstrip line is coupled to the first end of the signal transmission line; and a second microstrip line forming a J-shape, wherein a first end of the second microstrip line is coupled to a second end of the first microstrip line, and a second end of the second microstrip line is in an open state.

10. The multiplex power distribution circuit of claim 9, wherein the first transmission sub-circuit and the second transmission sub-circuit each further comprises a second open transmission line coupled to a second end of the signal transmission line.

11. The multiplex power distribution circuit of claim 10, wherein the second open transmission line comprises:

a third microstrip line forming an L-shape, wherein a bending direction of the third microstrip line is opposite to a bending direction of the first microstrip line, and a first end of the third microstrip line is coupled vertically to a second end of the signal transmission line; and a fourth microstrip line forming a J-shape, wherein a bending direction of the fourth microstrip line is opposite to a bending direction of the second microstrip line, a first end of the fourth microstrip line is coupled to a second end of the third microstrip line, and a second end of the fourth microstrip line is in an open state.

12. The multiplex power distribution circuit of claim 11, wherein a width of the first microstrip line is narrower than a width of the second microstrip line, and a width of the third microstrip line is narrower than the width of a fourth microstrip line.

13. The multiplex power distribution circuit of claim 12, wherein a rectangular gap is formed between the second microstrip line and the fourth microstrip line.

14. The multiplex power distribution circuit of claim 9, wherein the signal transmission line comprises a matching portion, a fifth microstrip line, an inductor and a sixth microstrip line coupled in series.

15. The multiplex power distribution circuit of claim 14, wherein the matching portion is a microstrip line structure, and a width of the microstrip line of the matching portion is gradually widened from the first portion toward the fifth microstrip line.

16. The multiplex power distribution circuit of claim 9, wherein the isolation element is an isolation resistor.

17. A multiplex power distribution circuit, comprising a plurality of power distribution circuits connected together, wherein each power distribution circuit of the multiplex power distribution circuits comprises:

a first portion, a second portion and a third portion;

an isolation element, coupled between the second portion and the third portion;

a first transmission sub-circuit set on one side of the isolation element, and coupled between the first portion and the second portion; and a second transmission sub-circuit set on the other side of the isolation element, and coupled between the first portion and the third portion, wherein the first transmission sub-circuit and the second transmission sub-circuit are symmetrically set on two sides of the isolation element;

wherein the first transmission sub-circuit and the second transmission sub-circuit each comprise a signal transmission line and a first open transmission line coupled to a first end of the signal transmission line, and wherein the first open transmission line comprises:

a first microstrip line forming an L-shape, wherein a first end of the first microstrip line is coupled to the first end of the signal transmission line; and a second microstrip line forming a J-shape, wherein a first end of the second microstrip line is coupled to a second end of the first microstrip line, and a second end of the second microstrip line is in an open state, wherein the second portion and the third portion of one of the multiplex power distribution circuit is coupled to the first portion of other two power distribution circuit respectively.

* * * * *